US012774590B2

(12) United States Patent
Anderson

(10) Patent No.: US 12,774,590 B2
(45) Date of Patent: Oct. 27, 2026

(54) WALL FAUCET ASSEMBLY

(71) Applicant: MERRILL MANUFACTURING COMPANY, Storm Lake, IA (US)

(72) Inventor: Stephen J. Anderson, Storm Lake, IA (US)

(73) Assignee: Merrill Manufacturing Co., Inc., Storm Lake, IA (US)

( * ) Notice: Subject to any disclaimer, the term of this patent is extended or adjusted under 35 U.S.C. 154(b) by 0 days.

(21) Appl. No.: 18/654,986

(22) Filed: May 3, 2024

(65) Prior Publication Data

US 2024/0368861 A1 Nov. 7, 2024

Related U.S. Application Data

(60) Provisional application No. 63/499,861, filed on May 3, 2023.

(51) Int. Cl.
*E03B 9/02* (2006.01)
*E03B 9/20* (2006.01)

(52) U.S. Cl.
CPC ..... *E03B 9/025* (2013.01); *E03B 9/20* (2013.01)

(58) Field of Classification Search
CPC . E03B 9/025; E03B 9/00–20; E03B 2009/022
USPC ..... 137/215–218, 317–325, 343, 899–899.4, 137/345–382.5, 801, 614.06, 843–860, 137/272–308; 251/149–149.9; 217/100, 217/101, 107; 4/678
See application file for complete search history.

(56) References Cited

U.S. PATENT DOCUMENTS 1,016,744 A * 2/1912 Haymaker ..... F16L 37/252 285/376
1,024,971 A * 4/1912 Brague ..... B67D 1/0832 217/100
1,164,077 A * 12/1915 Duey et al. ..... E03B 9/16 137/299
1,580,312 A * 4/1926 Long ..... F16L 37/006 251/149
1,968,075 A * 7/1934 Ewald ..... F16L 37/252 285/91
2,579,855 A * 12/1951 Pockel ..... F16K 15/148 137/854
2,598,009 A * 5/1952 Peeps ..... F16L 37/248 285/379
3,494,373 A * 2/1970 Horak ..... E03B 9/025 251/149.6
3,523,549 A 8/1970 Anderson
3,672,392 A 6/1972 Anderson
3,980,097 A * 9/1976 Ellis ..... F16K 15/148 137/283
4,338,933 A * 7/1982 Bayard ..... A61M 39/14 604/905

(Continued)

*Primary Examiner* — Craig J Price
(74) *Attorney, Agent, or Firm* — ZarleyConley PLC

(57) ABSTRACT

Various aspects of a wall faucet assembly are discussed herein, including an inner assembly that is configured to removably connect to an outer assembly. When connected, a water line connected to the outer assembly passes from the outer assembly to the inner assembly when the inner assembly is manipulated to an operative position. The inner assembly may not require a handle or key for operation and further provides a vacuum breaker to prevent a backflow with an umbrella valve.

5 Claims, 11 Drawing Sheets

(56) References Cited

U.S. PATENT DOCUMENTS

| | | | | | |
|---|---|---|---|---|---|
| 4,510,969 | A * | 4/1985 | Rodth | F16L 37/107 | 137/614.04 |
| 4,538,637 | A * | 9/1985 | Williams | E03B 9/025 | 251/318 |
| 4,745,950 | A * | 5/1988 | Mathieu | A61M 39/26 | 604/905 |
| 4,874,189 | A * | 10/1989 | Gardner | E03C 1/042 | 285/142.1 |
| 5,143,346 | A * | 9/1992 | Chen | E03B 7/09 | 137/322 |
| 5,165,121 | A * | 11/1992 | McTargett | E03C 1/02 | 4/678 |
| 5,722,450 | A * | 3/1998 | Julicher | E03B 9/06 | 137/382.5 |
| 5,803,508 | A * | 9/1998 | Lowella | E03C 1/042 | 285/137.11 |
| 6,006,784 | A * | 12/1999 | Tsutsui | E03C 1/057 | 137/359 |
| 6,116,265 | A | 9/2000 | Drake | | |
| 6,125,875 | A * | 10/2000 | Dempsey | E03C 1/108 | 137/217 |
| 7,082,966 | B2 * | 8/2006 | Kuo | E03C 1/0404 | 4/678 |
| 8,074,675 | B2 * | 12/2011 | Thomas | E03C 1/04 | 137/359 |
| 11,851,857 | B2 * | 12/2023 | Laws | E03B 9/02 | |
| 2013/0042406 | A1 * | 2/2013 | Marotz | E03C 1/2304 | 137/359 |
| 2023/0193602 | A1 * | 6/2023 | Schulte | E03C 1/0403 | 137/315.12 |

* cited by examiner

WALL FAUCET ASSEMBLY

CROSS REFERENCE TO RELATED APPLICATION

This application claims the benefit U.S. Provisional Application Ser. No. 63/499,861 filed May 3, 2023.

FIELD OF INVENTION

The various aspects disclosed herein relates to a wall faucet assembly, including a high flow wall faucet assembly having modular components.

BACKGROUND OF THE INVENTION

Wall faucet assemblies are known in the art. Usually, one or more wall faucet assembly is located on the exterior of a home to allow a resident to connect a hose for irrigation and recreational purposes. While current wall faucet assemblies are useful, several deficiencies exist.

Problems exist with the handles and keys used to turn the wall faucet assembly off and on. Conventional handles are prone to leakage or breakage. Replacement of the handle is not a simple task and often requires the replacement of multiple components beyond just the handle. Handles, keys, and the like often pose an obstruction to a resident who is attempting to connect a hose. This obstruction makes aligning the threads on the hose to those on the wall faucet assembly difficult and further inhibits the ability to readily screw the two components together, especially when a tool, such as a wrench, is used to tighten the connection to be watertight. Further problems relate to the packing gland seal and stems of conventional wall faucets, which frequently lead to leakage and low flow rates.

Further problems relate to back flow. Back flow can occur when there is a substantial draw on a water supply, such as when a firetruck draws from a main water supply, resulting in a back siphon of water into the home creating a back flow that leads to contamination. One advancement to address this issue is a vacuum breaker or backflow preventer that allows air to back flow rather than water. Most faucets now require vacuum breakers to prevent such a back flow, yet problems remain. Existing vacuum breakers use a plug or bonnet and an O-ring that are prone to leakage, inefficient, and carry a significant cost.

Freezing is an ever-present concern in many areas, which can lead to substantial damage to a home if water remains in a wall faucet assembly, such as when a resident fails to disconnect a hose in the fall and winter. Even if damage does not occur within the home due to freezing, damage to the wall faucet assembly can be considerable and requires replacement of the majority, if not the entirety of the wall faucet assembly.

Another problem involves tampering or vandalism of a wall faucet assembly. Such occurrences can be caused by a nefarious bad actor or simply by a pet that discovers how to operate the wall faucet assembly. The misuse of a wall assembly can result in damage to the wall faucet assembly or a substantial water bill for water not being utilized by the resident.

Yet another problem relates to low flow rates. Oftentimes, a location has a single wall faucet assembly that is readily available absent the use of costly hoses that are longer or leaky interconnected hoses. As a result, it can be difficult, if not impossible, to operate multiple implements (e.g., a sprinkler) at one time to cover a desired area.

As many of the problems discussed involve replacement or repair, another problem stems from the inability to service the wall faucet assembly onsite. Instead, repairs and replacements often require several tools and interactions both inside and outside of the home, dwelling, or location to permit service.

Thus it is a primary aspect of this disclosure to provide a wall faucet assembly that improves upon the art, including by way of one or more of the following.

Another aspect of this disclosure is to provide a wall faucet assembly that does not require a handle or key to operate.

Yet another aspect of this disclosure is to provide a wall faucet assembly that increases water flow rate.

Another aspect of this disclosure is to provide a wall faucet assembly that eliminates the need for a packing gland and operating stem.

Yet another aspect of this disclosure is to provide a wall faucet assembly that utilizes a pipe-in-pipe design permitting simplified servicing.

Another aspect of this disclosure is to provide a wall faucet assembly that utilizes a modular design for internal and external components.

Yet another aspect of this disclosure is to provide a wall faucet assembly that provides a user-friendly design that is easy to use.

Another aspect of this disclosure is to provide a wall faucet assembly that allows onsite replacement or repair with minimal or no additional tools.

Yet another aspect of this disclosure is to provide a wall faucet assembly that is low cost.

Another aspect of this disclosure is to provide a wall faucet assembly that lends to the use of polymer materials.

Yet another aspect of this disclosure is to provide a wall faucet assembly that limits or prevents tampering and vandalism.

Another aspect of this disclosure is to provide a wall faucet assembly that provides an improved vacuum breaker.

Yet another aspect of this disclosure is to provide a wall faucet assembly that facilitates connection of a hose.

These and other aspects, features, and advantages of the invention will become apparent from the specification and claims.

SUMMARY OF THE INVENTION

Discussed herein are various wall faucet assemblies and related systems and methods.

In Example 1, a wall faucet assembly comprises an outer assembly that has an outer pipe and an inner assembly that has an inner pipe. The inner assembly and outer assembly are interlocked such that the inner pipe is positioned through the outer pipe.

Example 2 relates to the wall faucet assembly according to Example 1, further comprising the inner assembly has a faucet that is connected to the inner pipe. The faucet outlet has a slot formed in its body.

Example 3 relates to the wall faucet assembly according to Example 2, further comprising the outer assembly has a wall mount that connects to the inner pipe. The wall mount has a guide that is received through the slot on the faucet outlet.

Example 4 relates to the wall faucet assembly according to Example 3, wherein the faucet outlet is slidably connected to the wall mount via the slot. The distance the faucet outlet can slide is limited by the guide of the wall mount.

Example 5 relates to the wall faucet assembly according to Example 4, further comprising the slot having a horizontal portion and a vertical portion, which may be substantially in the form of an "L" shape.

Example 6 relates to the wall faucet assembly according to Example 5, wherein the faucet outlet is rotatable about the wall mount via the slot. The distance the faucet outlet can rotate is limited by the guide of the wall mount.

Example 7 relates to the wall faucet assembly according to Example 6, wherein the vertical portion of the slot angles away from the inner pipe, i.e., towards the interior end thereby presenting the slot as an acute angle, such that the guide is retained in the vertical portion without manual intervention from an individual.

Example 8 relates to the wall faucet assembly according to Example 1, further comprising the outer assembly has a wall mount that threads into the outer pipe. The inner pipe of the inner assembly threads into a faucet at one end and a plunger at an opposing end.

Example 9 relates to the wall faucet assembly according to Example 1, further comprising the outer assembly has a valve body that connects to the outer pipe and the inner assembly has a plunger that connects to the inner pipe. The plunger is slidably received within the valve body.

Example 10 relates to the wall faucet assembly according to Example 9, further comprising the valve body has a central portion with a smaller diameter to which a sleeve is positioned. The sleeve and the plunger form a watertight seal in some positions of operation.

Example 11 relates to the wall faucet assembly according to Example 10, further comprising the plunger has an open-end wall at one end and an enclosed end at the other end with a sidewall disposed between the two ends. The sidewall has a rib that forms a channel that an O-ring is positioned in. The plunger has an aperture that allows water to pass from the valve body, through the plunger, and into the inner pipe.

Example 12 relates to the wall faucet assembly according to Example 1, further comprising the inner assembly has a vacuum break that includes an umbrella valve.

Example 13 relates to the wall faucet assembly according to Example 12, further comprising the vacuum breaker has a perforated bottom wall and a sidewall that ends therefrom. The umbrella valve is connected to the perforated bottom wall.

Example 14 relates to the wall faucet assembly according to Example 13, further comprising the umbrella valve has a post, a stop, and a disc. The post is received in the perforated bottom wall, the stop is positioned within a body of the faucet outlet, and the disc forms a canopy that covers the perforated bottom wall from within the opening of the body of the faucet outlet.

Example 15 relates to the wall faucet assembly according to Example 14, wherein the disc is a silicone member that blocks water from coming up through the body into the vacuum breaker via the perforated bottom wall. When a back flow occurs, however, the disc distorts away from this position to allow air to be drawn through the perforated bottom wall and into the inner pipe via the faucet outlet.

Example 16 relates to the wall faucet assembly according to Example 12, further comprising the vacuum breaker has a cap that is attached to a ridge of the sidewall. The sidewall is slotted to compress slightly to allow easier removal and reattachment of the cap.

Example 17 relates to the wall faucet assembly according to Example 1, further comprising the inner assembly has a faucet outlet that slides along the outer assembly. The faucet outlet has a lock lever assembly that locks the position of the faucet outlet in relation to the outer assembly.

Example 18 relates to the wall faucet assembly according to Example 17, further comprising the lock lever assembly having a wing lever operatively and rotatably connected to a set pin.

Example 19 relates to the wall faucet assembly according to Example 18, further comprising the outer assembly having a wall mount that is received within the faucet outlet. The wall mount has a set of indentations that selectively receive the set pin to lock the position of the faucet outlet on the wall mount.

Example 20 relates to the wall faucet assembly according to Example 1, further comprising the inner assembly has a faucet outlet that bends at an angle to facilitate connection of a hose and the wall faucet assembly does not operate by way of a handle or a key.

This has outlined, rather broadly, the features, advantages, solutions, and benefits of the disclosure in order that the description that follows may be better understood. Additional features, advantages, solutions, and benefits of the disclosure will be described in the following. It should be appreciated by those skilled in the art that this disclosure may be readily utilized as a basis for modifying or designing other structures and related operations for carrying out the same purposes of the present disclosure. It should also be realized by those skilled in the art that such equivalent constructions and related operation do not depart from the teachings of the disclosure as set forth in the appended claims. The novel features, together with further objects and advantages, will be better understood from the following description when considered in connection with the accompanying Figures. It is to be expressly understood, however, that each of the Figures is provided for the purpose of illustration and description only and is not intended as a definition of the limits of the present disclosure.

DETAILED DESCRIPTION

Figure 1:
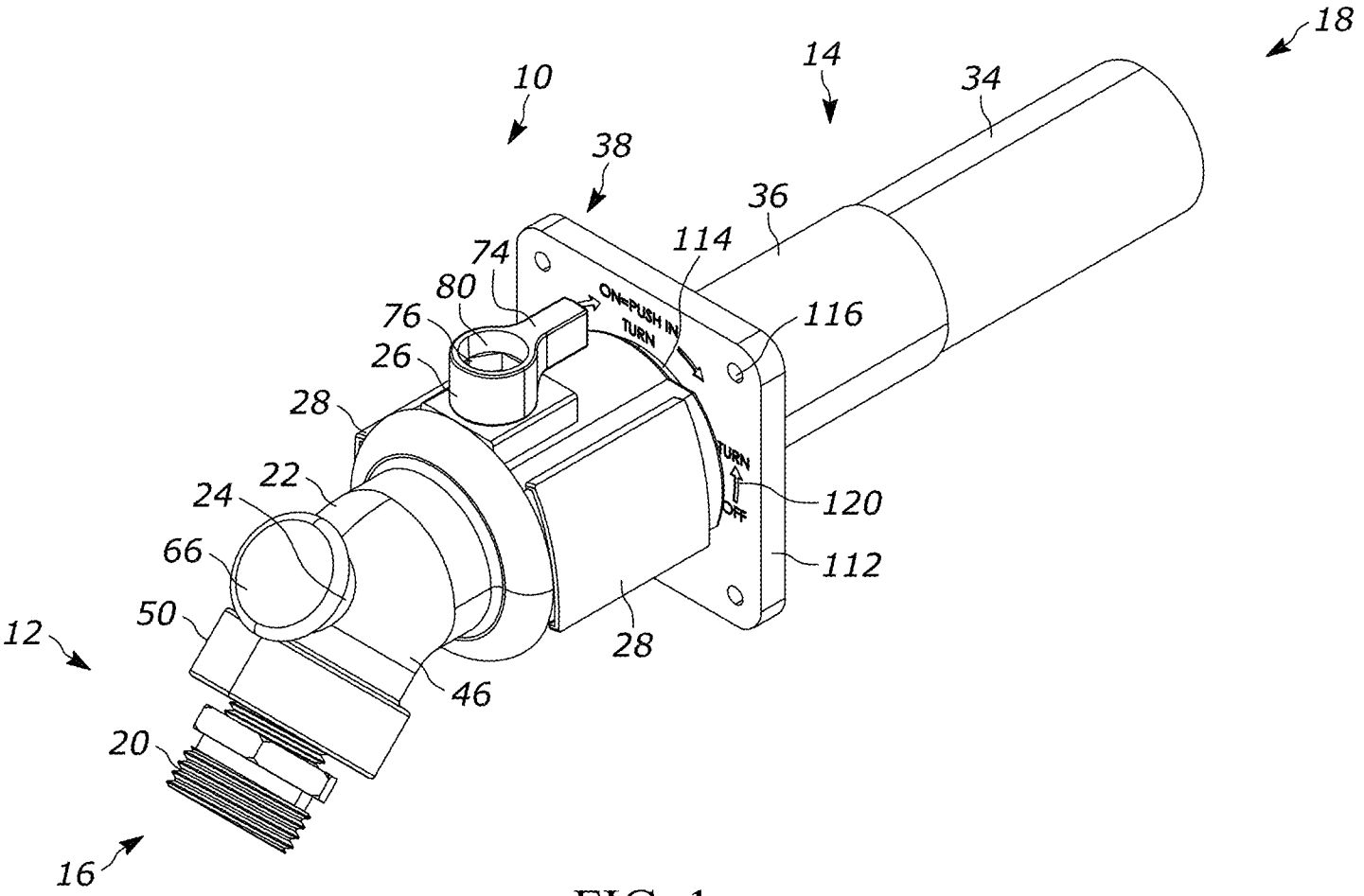
FIG. 1 is a perspective view of a wall faucet assembly according to an aspect of the disclosure.

The disclosure described herein is directed to different aspects of a wall faucet assembly. The detailed description set forth below, in connection with the appended drawings, is intended as a description of various configurations and is not intended to represent the only configurations in which the concepts described herein may be practiced. These descriptions include specific details for the purpose of providing a thorough understanding of the various concepts. It will be apparent, however, to those skilled in the art that these concepts may be practiced without these specific details.

The various aspects disclosed and contemplated herein relate to wall faucet assemblies (and related systems and methods) designed to achieve satisfactory benefits over traditional wall faucet assemblies. The disclosure herein may refer to certain aspects, iterations, embodiments, and examples but it is understood that the disclosure can be embodied in many different forms and should not be construed as limited to the aspects set forth herein. For instance, reference is made to a plurality or a pair of an element, where a singular or more than two of such element is contemplated.

Although the terms first, second, etc. may be used herein to describe various elements or components, these elements or components should not be limited by these terms. These terms are only used to distinguish one element or component from another. Hence, a first element discussed herein could be termed a second element without departing from the teachings of the present application. It is understood that actual systems or fixtures embodying the disclosure can be arranged in many different ways with many more features and elements beyond what is shown in the drawings. For the same or similar elements or features, the same reference numbers may be used throughout the disclosure.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the disclosure in addition to the orientation depicted in the Figures. Contemplation of aspects involving direct connections are further provided in the aspects presented in the Figures.

With reference to FIGS. 1-14B aspects that may comprise a wall faucet assembly 10 are shown.

FIG. 1 depicts a wall faucet assembly 10 may comprise an inner assembly 12 and an outer assembly 14. The inner assembly 12, from an exterior end 16 to an interior end 18 of the wall faucet assembly 10, may comprise a hose adapter 20, a faucet outlet 22 that may have a vacuum breaker 24 and/or a lock lever assembly 26 and/or a pair of covers 28, an inner pipe 30, and a plunger 32. The outer assembly 14, from the interior end 18 to the exterior end 16 of the wall faucet assembly 10, may comprise a valve body 34, and exterior pipe 36, and a wall mount 38. Reference to the exterior end 16 and the interior end 18 is made in relation to the commonly understood position of the exterior being in the direction away or without a building 40 (not shown) whereas the interior is directed toward or within the building 40.

The inner assembly 12 may be configured to removably be received within and about the outer assembly 14 to permit the flow of water from a water line 42 (not shown) located within the building to pass through the wall faucet assembly 10 and out from the exterior end 16, which may then pass into a hose 44 (not shown) that is connected to the wall faucet assembly 10.

The hose adapter 20 may be configured to permit connection with the hose 44 such as by threaded connection. The hose adapter 20 may threadably connect to the faucet outlet 22. With additional reference to at least FIG. 3, the outer diameter of the hose adapter 20 may be threaded to allow threaded connection to an inner diameter of the faucet outlet 22 and/or hose 44. The hose adapter 20 may be made of brass or other suitable material.

With additional reference to at least FIGS. 2 and 3, and FIGS. 5-8, the faucet outlet 22 has a body 46 that may be configured with an opening 48 that slidably and partially rotationally receives the wall mount 38 at least partially within as discussed further herein. The body 46 may be formed in an angle such that the faucet outlet 22 bends downwardly towards the exterior end 16, which in turn positions the hose adapter 20 at a downward angle to facilitate connection with the hose 44. The body 46 may have a head 50 that may be rotatable to allow the head 50 to be rotated in turn rotate the hose adapter 20 in order to connect the hose 44.

The opening 48 of the body 46 may have two different inner diameters. As shown in at least FIGS. 3 and 8, the inner diameter of the opening 48 positioned towards the exterior end 16 may be smaller than the inner diameter of the opening 48 positioned towards the interior end 18. In such a configuration, the larger inner diameter allows the wall mount 38 to be received within but the smaller inner diameter of the opening 48 prevents the wall mount 38 from being received further within the body 46.

Figure 2:
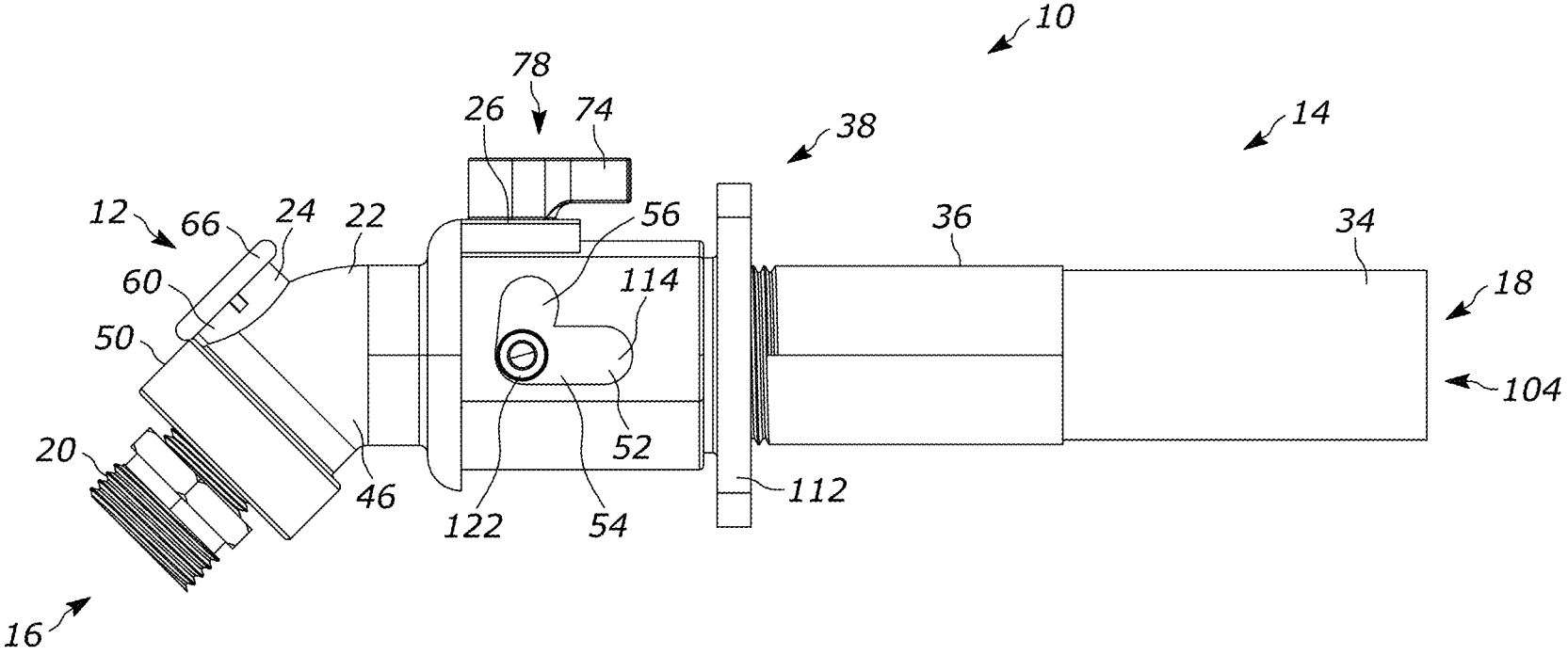
FIG. 2 is a side view of a wall faucet assembly according to an aspect of the disclosure.
Figure 7:
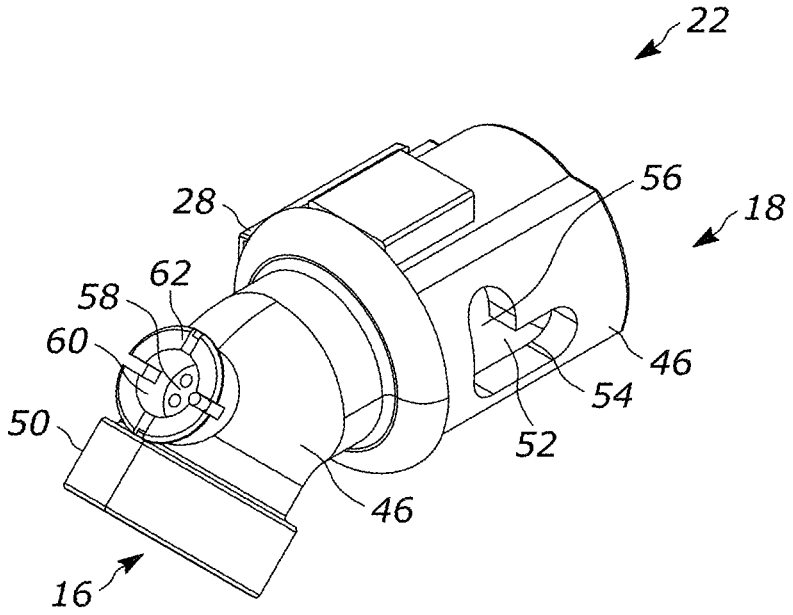
FIG. 7 is a perspective view of a faucet outlet of a wall faucet assembly according to an aspect of the disclosure.
Figure 8:
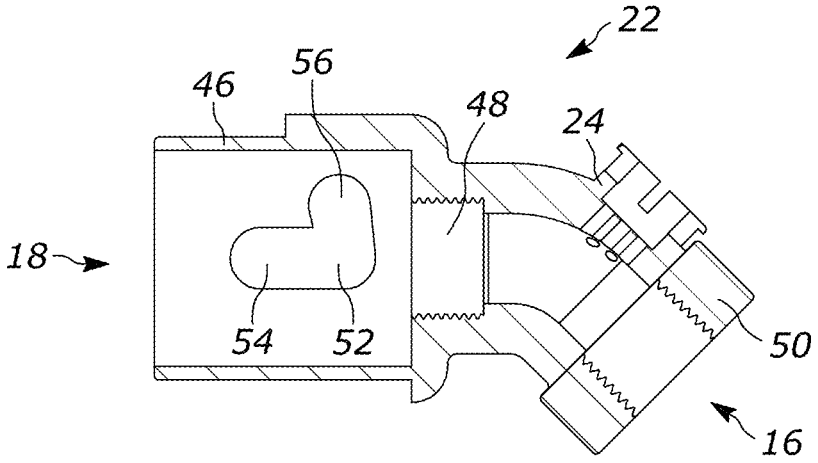
FIG. 8 is a side, cross-sectional view of a faucet outlet of a wall faucet assembly according to an aspect of the disclosure.
Figure 9:
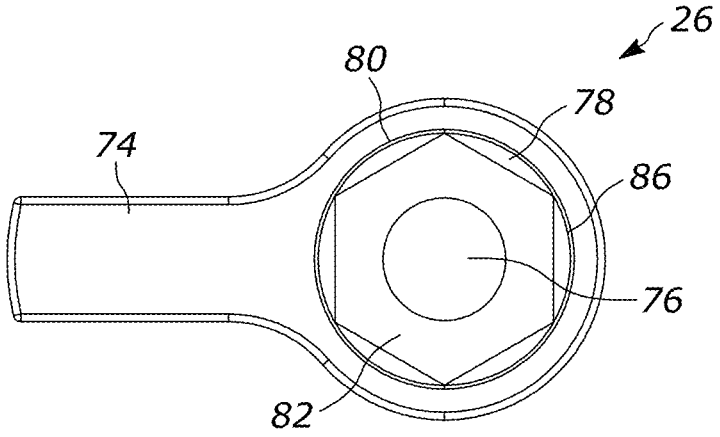
FIG. 9 is a top view of a lock lever assembly of a wall faucet assembly according to an aspect of the disclosure.
Figure 10:
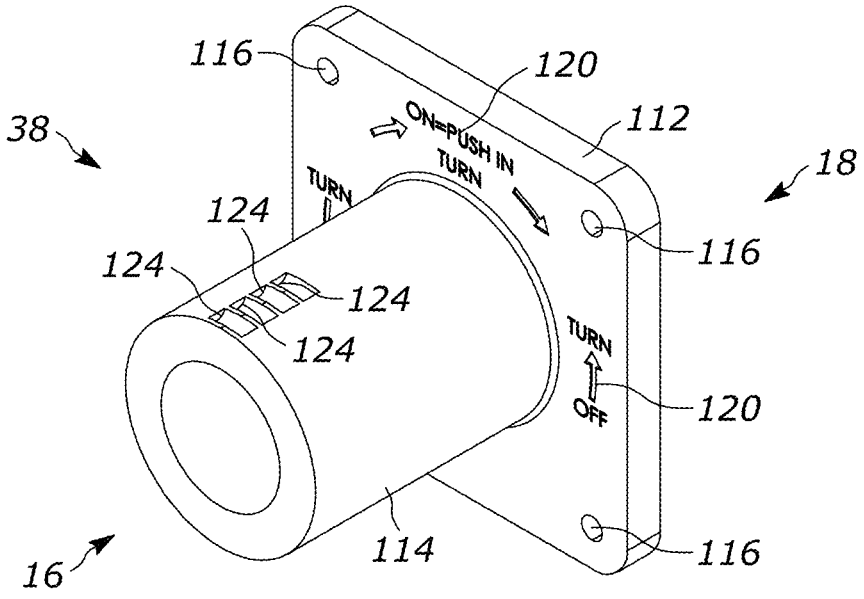
FIG. 10 is a perspective view of a wall mount of a wall faucet assembly according to an aspect of the disclosure.

With further reference to at least FIGS. 2, 7, and 8, the body 46 may comprise a pair of slots 52 that limit the slidable and rotational connection of the faucet outlet 22 to the wall mount 38. In some aspects, the pair of slots 52 are positioned on opposing sides of the body 46 that facilitates operation as discussed herein given the ergonomic positioning of the pair of slots 52. As shown in at least FIGS. 2 and 8, the pair of slots 52 may be formed in an L-shape having a horizontal portion 54 and a vertical portion 56 whereby the horizontal portion 54 guides and limits the horizontal or slidable movement of the faucet outlet 22 in relation to the wall mount 38 and the vertical portion 56 guides the vertical or rotational movement of the faucet outlet 22 in relation to the wall mount 38. The vertical portion 56 may be configured to lock the position of the faucet outlet 22 in place in relation to the wall mount 38 as discussed further herein. In some such aspects, the vertical portion 56 is configured to angle back towards the exterior end 16 to facilitate the locking operation. While the Figures depict two such slots that are inverted in relation to one another about the body 46 to allow the described operation, it is hereby contemplated that a single or more than two slots may accomplish the same objective, however, the ergonomic advantages will not be achieved to the same degree and the use of additional slots would increase the cost of creation of the wall faucet assembly 10 and increase the time to service as discussed herein.

Figure 4:
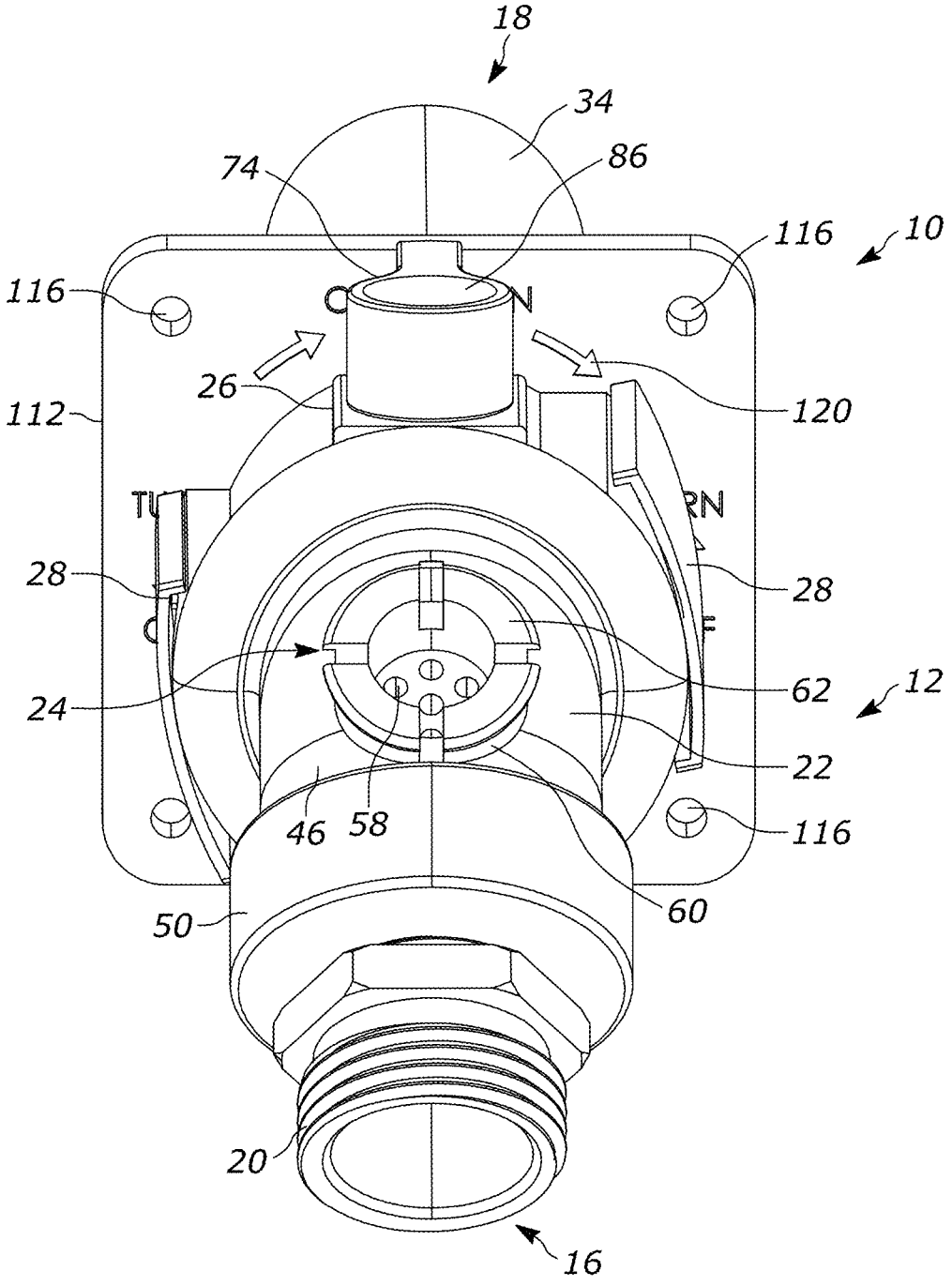
FIG. 4 is a front view of a wall faucet assembly according to an aspect of the disclosure.
Figure 5:
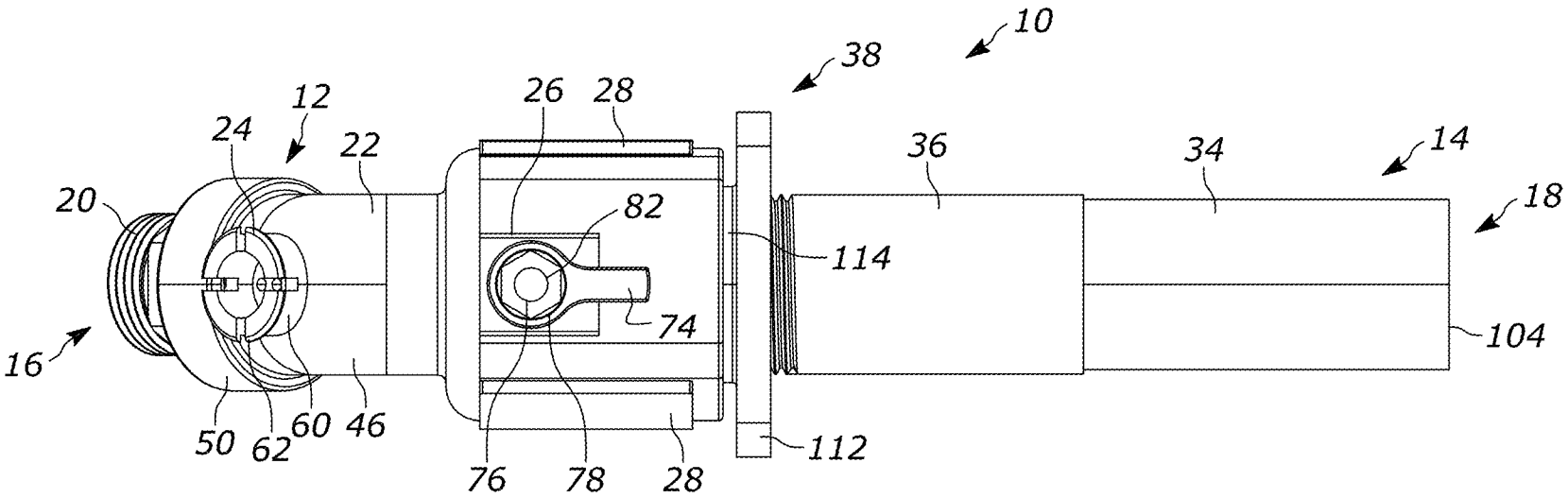
FIG. 5 is a top view of a wall faucet assembly according to an aspect of the disclosure.

As seen in at least FIGS. 1, 4, and 5, the pair of slots 52 may be covered by a pair of covers 28 that removably connect to the body 46 such as by way of a set screw, friction fit, or clipping to the body 46. The removable configuration of the pair of covers 28 is configured to facilitate access to perform repairs while also providing protection to the body 46 to prevent contaminants and debris from entering the wall faucet assembly 10 via the pair of slots 52. While the Figures depict two such covers, it is hereby contemplated that one or more such covers would accomplish the same advantages, however, when the pair of slots 52 are present the use of separate covers provides the advantage of limiting exposure of the faucet outlet 22 to the site of repair.

FIGS. 3-5 and FIG. 7 depict the vacuum breaker 24 may be integrated into the body 46 of the faucet outlet 22. The vacuum breaker 24 may comprise one or more of a perforated bottom wall 58, a sidewall 60, an upper ridge 62, and an umbrella valve 64. The perforated bottom wall 58 permits exterior air to be pulled into the opening 48 of the body 46 to back siphon air rather than water in the event of a back flow as discussed further herein. The sidewall 60 extends away from the body 46 and may be slotted to facilitate the removable attachment of a cap 66 to the upper ridge 62 of the sidewall 60 where the upper ridge 62 is received in the cap 66 to retain the cap 66 in place while the slots that may be in the sidewall 60 allow the sidewall 60 to flex or compress inwardly to facilitate removal of the cap 66.

Figure 3:
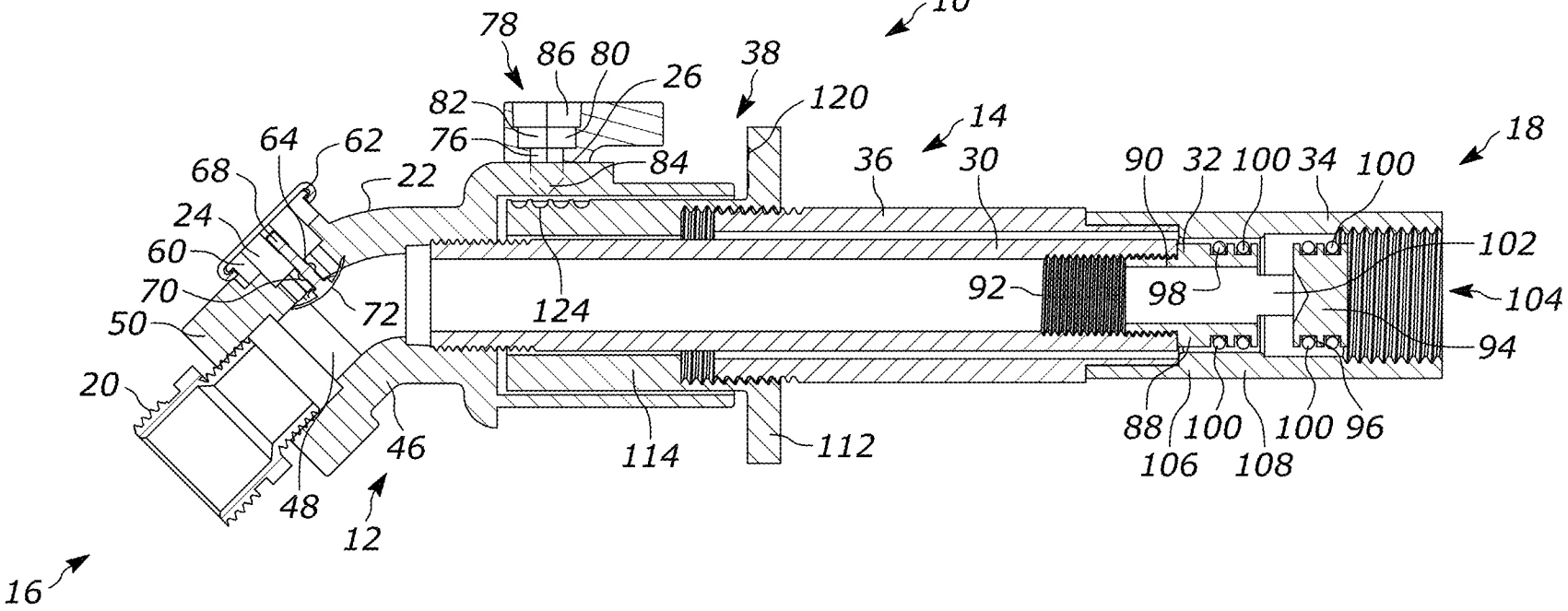
FIG. 3 is a side, cross-sectional view of a wall faucet assembly according to an aspect of the disclosure.

The umbrella valve 64, as seen in FIG. 3, may comprise a post 68, a stop 70, and a disc 72. The post 68, the stop 70, and/or the disc 72 may be made of a silicone such that the disc 72 forms a silicone membrane. The post 68 may be positioned through the body 46 of the faucet outlet 22 and into the perforated bottom wall 58 of the vacuum breaker 24 to hold the umbrella valve 64 in place. To further affix the position the umbrella valve 64, the stop 70 may be positioned within the body 46 between or within the perforated bottom wall 58. The stop 70 facilitates affixing the position of the umbrella valve 64 by having a larger diameter in relation to the diameter of the post 68. The disc 72 is configured to provide a canopy to block water from passing through the perforated bottom wall 58 during normal operation due to the pressure applied from the flowing water. In the event of a backflow, the disc 72 is configured to distort away from the perforated bottom wall 58 due to the vacuum the back flow creates to allow air to pass through the perforated bottom wall 58 and through the inner assembly 12 in the direction of the interior end 18. The cap 66 protects debris and contaminants from blocking or inhibiting this configuration while remaining removable to allow operation when needed.

Figure 14A:
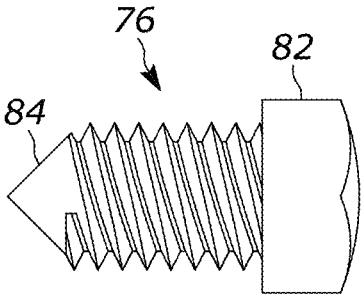
FIG. 14A is a side view of a set pin of a wall faucet assembly according to an aspect of the disclosure.
Figure 14B:
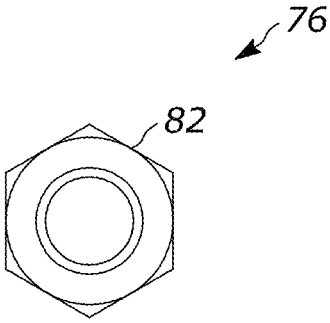
FIG. 14B is a top view of a set pin of a wall faucet assembly according to an aspect of the disclosure.

FIGS. 1-5, 9, 14A, and 14B depict aspects of the lock lever assembly 26 that is configured to lock the position of the faucet outlet 22 in relation to the wall mount 38 at varying locations. The lock lever assembly 26 may comprise a lever or a wing lever 74 and/or a set pin 76. The wing lever 74 may be connected to the body 46 of the faucet outlet 22 by the set pin 76 passing through an opening 78 that extend through the wing lever 74 and the body 46 such that the set pin 76 engages the wall mount 38 as seen generally in FIG. 3. In some aspects, the wing lever 74 has a plurality of recesses 80 of which at least one may be shaped in the form of a hex head to engage a head 82 of the set pin 76 to permit rotation with the wing lever 74, which in some aspects the set pin 76 is a hex head screw the with a cone point end 84 as shown in FIGS. 14A and 14B. Rotation of the wing lever 74 raises and lowers the set pin 76 such that the set pin 76 is lowered to engage the wall mount 38 to prevent movement of the faucet outlet 22 in relation to the wall mount 38 or raised to disengage the wall mount 38 to allow such movement. When raised, a headspace 86 within the opening 78 formed by the plurality of recesses 80 allows the set pin 76 to rise without protruding above the wing lever 74.

Figure 6:
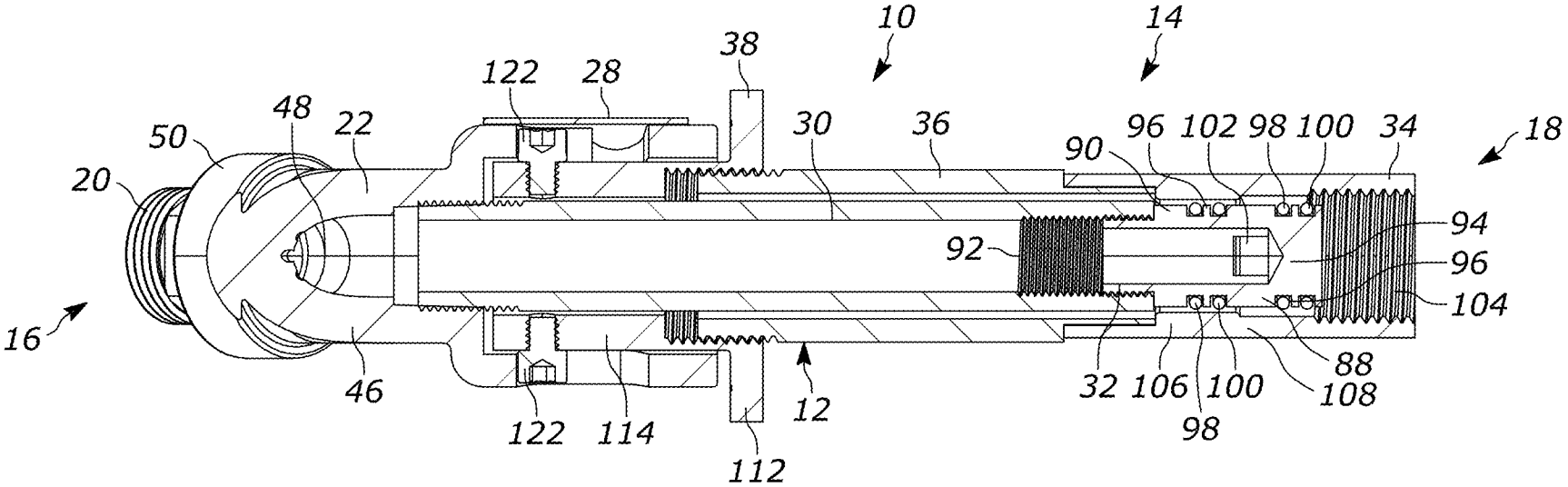
FIG. 6 is a top, cross-sectional view of a wall faucet assembly according to an aspect of the disclosure.

FIGS. 3 and 6 depict that the inner pipe 30 is configured to carry water from the plunger 32 to the faucet outlet 22. The inner pipe 30 may connect to the faucet outlet 22 including by way of a threaded connection between the outer diameter of the inner pipe 30 threading with the inner diameter of the faucet outlet 22 to the interior end 18 of the faucet outlet 22. The inner pipe 30 connects to the plunger 32 at the interior end 18 of the inner pipe 30. The inner pipe 30 may be a 0.5 inch PVC pipe.

Figure 11:
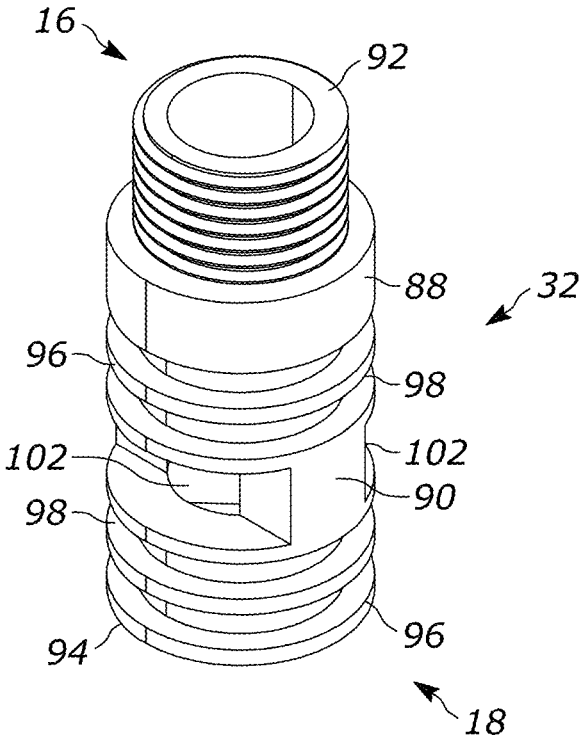
FIG. 11 is a perspective view of a plunger of a wall faucet assembly according to an aspect of the disclosure.
Figure 12:
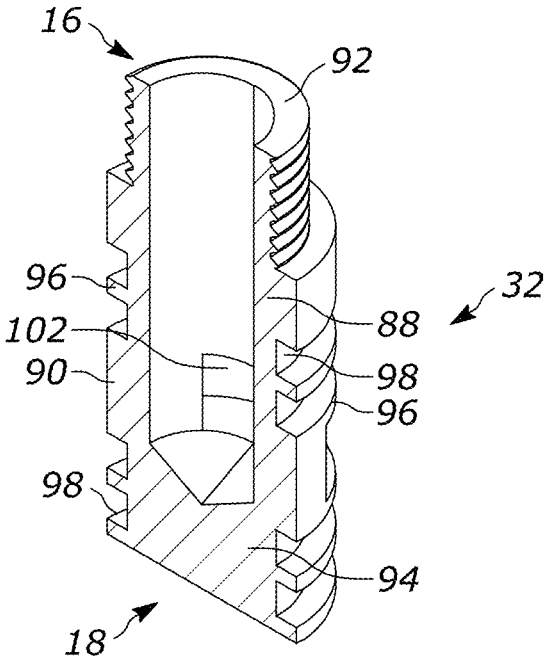
FIG. 12 is a perspective, cross-sectional view of a plunger of a wall faucet assembly according to an aspect of the disclosure.

With further reference to FIGS. 11 and 12, the plunger 32 is configured to block and unblock the flow of water into the inner assembly 12. The plunger 32 may comprise a body 88 formed by a sidewall 90 that extends between an open-end wall 92 and an enclosed end wall 94. As shown, the open-end wall 92 may be threaded to connect to the inner pipe 30, including by way of a threaded connected between the inner diameter of the inner pipe 30 with the outer diameter of the plunger 32. The enclosed end wall 94 is positioned to the interior in relation to the open-end wall 92 when the wall faucet assembly 10 is assembled. The sidewall 90 may comprise one or a plurality of ribs 96 on the outer diameter of the open-end wall 92 that form a plurality of channels 98 to receive one of a plurality of O-rings 100. The sidewall 90 may also comprise one or a pair of apertures 102. In some aspects, the plunger 32 is formed on a monolithic uniform body, which may be formed by way of molding.

Figure 13:
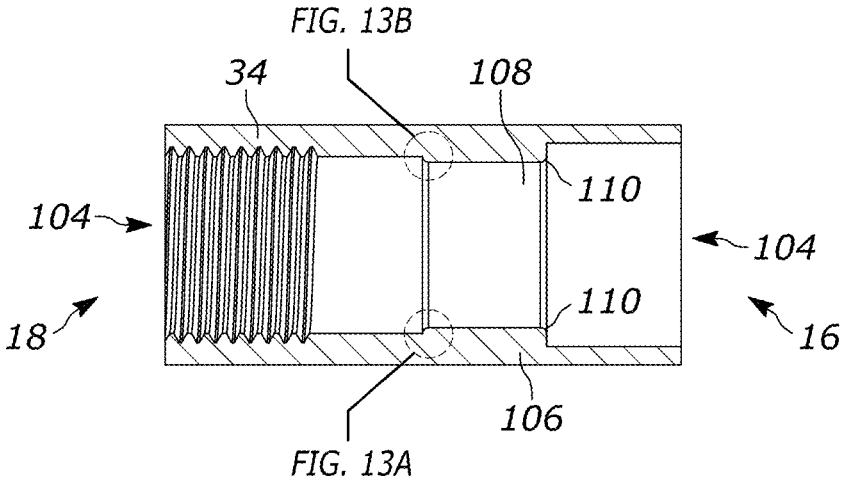
FIG. 13 is a side, cross-sectional view of a valve body of a wall faucet assembly according to an aspect of the disclosure.
Figure 13A:
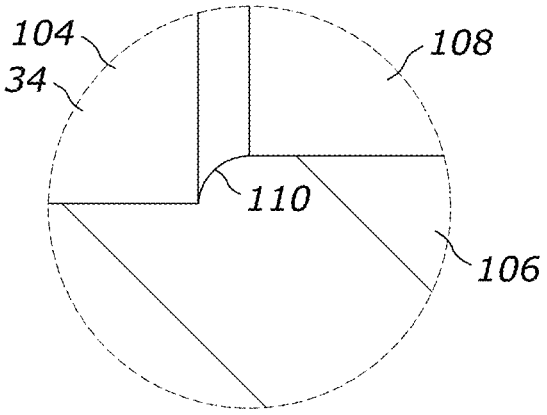
FIG. 13A is a detail view of FIG. 13 of a valve body of a wall faucet assembly according to an aspect of the disclosure.
Figure 13B:
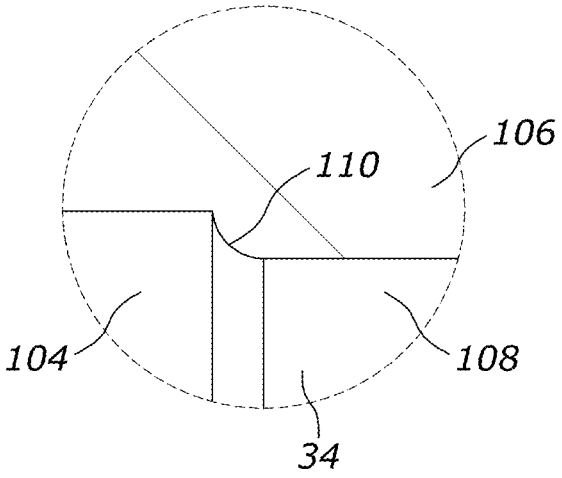
FIG. 13B is a detail view of FIG. 13 of a valve body of a wall faucet assembly according to an aspect of the disclosure.

In further reference to, at least, FIGS. 3, 6, 13, 13A, and 13B, the valve body 34 is configured to selectively receive the plunger 32 to control the flow of water through the wall faucet assembly 10 as discussed herein. The valve body 34 has an opening 104 extending therethrough that is configured to slidably receive the plunger 32 therethrough. A central portion 106 of the opening 104 may have a diameter that is smaller than that of the rest of the valve body 34. The reduced diameter may be formed by a sleeve 108 positioned in the central portion 106. In some aspects, the sleeve 108 is a stainless steel that is press fit into the central portion 106. The central portion 106 may be configured such that diameter is larger than the body 88 of the plunger 32 but smaller than the plurality of O-rings 100 such that when the plunger 32 passes through the central portion 106 and/or the sleeve 108, the plurality of O-rings 100 create a seal with the central portion 106 and/or the sleeve 108. The seal created with the sleeve 108 is enhanced when the sleeve is made of a stainless steel. With particular reference to FIGS. 13A and 13B, the sleeve 108 may have one or a plurality of corners 110 that are flare or rounded to facilitate movement of the plurality of O-rings 100 back and forth through the sleeve 108.

In an exemplary operation, the plunger 32 is retracted as discussed further herein such that the pair of apertures 102 are positioned within or to the exterior end 16 of the valve body 34. In such a position, the enclosed end wall 94 and plurality of O-rings 100 create a seal preventing water from passing into the pair of apertures 102, through the body 88 and out the open-end wall 92 of the plunger 32. Conversely, when the plunger is positioned through the sleeve 108 such that the apertures 102 are interior to the sleeve 108, water flows through the apertures 102 and out the plunger 32 through the open-end wall 92.

The valve body 34 may connect to the exterior pipe 36 at the interior end 18. The connection with the exterior pipe 36 may be accomplished by solvent welding. The exterior pipe 36 may have a reduced outer diameter at the interior end 18 to facilitate receipt within the valve body 34. It is also contemplated that the valve body 34 and the exterior pipe 36 of a monolithic uniform construction. The exterior pipe 36 is configured to have an inner diameter that is larger than the outer diameter of the inner pipe 30. In some such aspects, the exterior pipe 36 may have an outer diameter of 1.0 inches. The inner pipe 30 and the exterior pipe 36 may be configured to extend to the exterior of the building 40 as well as at least partially within the interior of the building 40. With reference to at least, FIGS. 1-3 and 6, the exterior pipe 36 extends from the valve body 34 to connect to or within the wall mount 38, such as by way of a threaded connection between the outer diameter of the valve body 34 and the inner diameter of the wall mount 38. One of plurality of O-rings 100 (not shown) may be positioned between the exterior end 16 of the valve body 34 and the wall mount 38.

With reference to, at least, FIGS. 1-6 and 10, the wall mount 38 is configured to attach to the exterior of the building 40 and provide stability to the wall faucet assembly 10. The wall mount 38 may comprise a mount plate 112 and/or a mount cylinder 114. The mount plate 112 may have a plurality of apertures 116 to receive a plurality of connectors 118 (not shown) to connect the mount plate 112 to the building 40 or any suitable surface. The mount plate 112 may further comprise an indicia 120 that provides instruction for usage.

The mount cylinder 114 may comprise one or more of a pair of guides 122 and a set of indentations 124. The pair of guides 122 may extend from opposing sides of the mount cylinder 114 and positioned, sized, and shaped to extend through the pair of slots 52, respectively. In this way, if the faucet outlet 22 is pushed towards the mount plate 112 the pair of guides 122 pass along the horizontal portion 54 until reaching the interconnection with the vertical portion 56 of the pair of slots 52 as seen in FIG. 2. Whereupon, the faucet outlet 22 can be rotated such that the pair of guides 122 pass along the vertical portion 56. If the faucet outlet 22 is released, the natural pressure caused by water flow through the inner assembly 12 will push the faucet outlet 22 outwardly to the exterior, however, movement is prevented through entrapment of the pair of guides 122 within the vertical portion 56 of the pair of slots 52. In this way, the wall faucet assembly 10 may be locked in an on position with a full flow. The pair of guides 122, in some aspects, may be thumb screws or pins that may have a cylinder head, which facilitate travel through the pair of slots 52 while further facilitating onsite repair and replacement due to the ability to remove the pair of guides 122 without tools.

The set of indentations 124 are configured to allow for a locked flow rate that is less than a full flow through interaction with the lock lever assembly 26. The set of indentations 124 are sized, shaped, and positioned such that when the faucet outlet 22 is positioned over the mount cylinder 114 the set pin 76 of the lock lever assembly 26 aligns with the most exterior of the set of indentations 124. In such a position, the lock lever assembly 26 may lock the wall faucet assembly 10 in a locked state without any water flow by turning the wing lever 74 to insert the set pin 76 in the exterior most of the set of indentations 124. This provides a deterrent to tampering. To allow a flow less than full flow, the faucet outlet 22 is partially pressed to the interior and towards the mount plate 112. The wing lever 74 is turned to lower the set pin 76 into one of the interior of the set of indentations 124. In some aspects, the interior most of the set of indentations 124 is positioned to align when the wall faucet assembly 10 is in a full flow position to provide an additional method to lock the relationship between the inner assembly 12 and outer assembly 14 in place in addition to that provided by the pair of slots 52 and the pair of guides 122.

To assemble the inner assembly 12 and the outer assembly 14, the inner pipe 30 is inserted and passes into the exterior pipe 36 as the plunger 32 is inserted into the valve body 34 as seen in FIG. 3. During insertion, the faucet outlet 22 is positioned around the mount cylinder 114 of the wall mount 38. In this way, the inner assembly 12 and the outer assembly 14 assemble to one another in an interlocking fashion. After insertion, the pair of guides 122 are inserted through the pair of slots 52 and into the mount cylinder 114. The pair of covers 28 are then placed over the pair of slots 52 and attached to the faucet outlet 22, and the cap 66 is placed over the vacuum breaker 24. After assembly, the hose 40 may be connected the hose adapter 20. The bend in the faucet outlet 22 facilitates attachment of the hose 40, which is further eased by the lack of a handle and/or the distance from the wall mount 38, and may further still be assisted in by the head 50. During initial installation, the water line 42 must also be connected to the valve body 34.

To operate, the faucet outlet 22 is pushed towards the wall mount 38 until a desired flow of water is reached. Flow rate is adjusted by moving the faucet outlet 22 in the exterior direction, which in turn moves the position of the plunger 32 within the valve body 34 to either prevent or allow passage of water through the body 88 of the plunger 32 by way of the apertures 102 in the sidewall 90 of the plunger 32. The flow of water can be locked at certain intervals between no flow and full flow. For instance, to lock at no flow, the lock lever assembly 26 is operated to place the set pin 76 in the exterior most of the set of indentations 124 on the mount cylinder 114. To lock the flow rate between no flow and full flow, the faucet outlet 22 is pushed into position to align with the more interior positions of the set of indentations 124 and the lock lever assembly 26 is similarly operated. To lock in full flow, the faucet outlet 22 is pushed until the pair of slots 52 reach the end of the horizontal portion 54 of the slots 52 and then the faucet outlet 22 is then rotated half a turn to pass the pair of guides 122 into the vertical portion 56, thereby preventing the faucet outlet 22 from auto shutting off due to water pressure as the slots 52 cannot move. If the wall faucet assembly 10 is not in a locked position and the faucet outlet 22 is not manually held in place, the flow of water will apply pressure to the plunger 32 towards the exterior end 16 and in turn moving the plunger 32 towards the exterior and into the sleeve 108 preventing water to pass through the plunger 32. When full flow is used, the absence of a stem and/or packing gland, and the size of the inner pipe 30 provides for a higher rate of flow, which in turn allows additional yard implements, such as multiple water sprinklers, to be fully functional even though both operate from a single of the wall faucet assembly 10.

To repair or replace components, the pair of covers 28 are removed from the faucet outlet 22. The pair of guides 122 are removed to allow the wall faucet assembly 10 to be withdrawn from the inner assembly 12. Removal of the pair of guides 122 may be completed without tools (e.g., where the pair of guides 122 are thumb screws). The components of the wall faucet assembly 10 are replaceable by unthreading the component to be replaced and threading the replacement component in place. Reassembly occurs in a similar manner as initial assembly discussed herein. Accordingly, onsite repair and replacement of the hose adapter 20, the faucet outlet 22, the inner pipe 30, and the plunger 32 is possible without the use of tools, e.g., wrench, screwdriver, power tool, etc. Likewise, the wall mount 38 may be replaced by disassembling the inner assembly 12 and the outer assembly 14 from one another, and then removing the plurality of connectors 118 from the mount plate 112 and unthreading the wall mount 38 from the exterior pipe 36. Hence the modular nature of the inner assembly 12 and the outer assembly 14, the inner assembly 12 is readily removed from the outer assembly 14 to facilitate onsite repair.

Some of the advantages of certain aspects disclosed herein include the following. The wall faucet assembly 10 has been provided that does not require a handle or key to operate, increases water flow rate, eliminates the need for a packing gland and operating stem, utilizes a pipe-in-pipe design permitting simplified servicing, utilizes a modular design for internal and external components, provides a user-friendly design that is easy to use, allows onsite replacement or repair with minimal or no additional tools, is low cost, lends to the use of polymer materials, limits or prevents tampering and vandalism, provides an improved vacuum breaker, facilitates connection of a hose, and improves upon the art.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

Although the present invention has been described with reference to embodiments, persons skilled in the art will recognize that changes may be made in form and detail without departing from the spirit and scope of the invention. The description is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

What is claimed is:

1. A wall faucet assembly comprising:

an outer assembly having an outer pipe;

an inner assembly having an inner pipe;

the outer assembly is interlocked with the inner assembly such that inner pipe is received through the outer pipe; and the outer assembly having a wall mount threadably connected to the outer pipe;

the inner assembly having a faucet outlet threadably connected to the inner pipe at an exterior end of the inner pipe; and a plunger threadably connected to the inner pipe at an interior end of the inner pipe.

2. A wall faucet assembly comprising:

an outer assembly having an outer pipe;

an inner assembly having an inner pipe;

the outer assembly is interlocked with the inner assembly such that the inner pipe is received through the outer pipe;

the outer assembly having a valve body connected to the outer pipe and the inner assembly having a plunger connected to the inner pipe, wherein the plunger is slidably received within the valve body; and the valve body having a central portion with a smaller diameter in relation to a remainder of the valve body, and a sleeve positioned in the central portion and configured to form a watertight seal with the plunger;

wherein the sleeve having at least one corner that has a flare configured to facilitate movement of the plunger.

3. The wall faucet assembly of claim 2 further comprising the plunger having an open-end wall at an exterior end and an enclosed end wall and a sidewall disposed therebetween, wherein the sidewall has at least one rib and at least one channel with an O-ring positioned within the at least one channel, and the sidewall having at least one aperture configured to pass water from the valve body through the plunger and into the inner pipe.

4. A wall faucet assembly comprising:

an outer assembly connected to a wall mount and an inner assembly;

the wall mount having a set of indentations; and the inner assembly having a faucet outlet adjustably connected to the outer assembly, and the faucet outlet having a lock lever assembly configured to lock a position of the faucet outlet in relation to the outer assembly through selective engagement of the lock lever assembly with the set of indentations.

5. The wall faucet assembly of claim 4 further comprising the lock lever assembly having a wing lever operatively and rotatably connected to a set pin.

* * * * *